United States Patent [19]

Robinson

[11] Patent Number: 4,599,747

[45] Date of Patent: Jul. 15, 1986

[54] BREAKDANCE APPAREL

[76] Inventor: Brian W. Robinson, 31 Ash La., Randolph, N.J. 07869

[21] Appl. No.: 648,748

[22] Filed: Sep. 10, 1984

[51] Int. Cl.[4] ..... A41D 13/00

[52] U.S. Cl. ..... 2/16; 2/2; 2/20; 2/24; 2/44

[58] Field of Search ..... 2/16, 20, 23, 24, 44, 2/45, 62, 2

[56] References Cited

U.S. PATENT DOCUMENTS

| | | | |
|---|---|---|---|
| 588,907 | 8/1897 | Herbelin | 2/24 |
| 2,250,267 | 7/1941 | Lins | 2/44 X |
| 2,418,009 | 3/1947 | Berman | 2/44 |
| 2,589,636 | 3/1952 | Smith | 2/2 X |
| 2,845,628 | 8/1958 | Dell | 2/20 |
| 3,406,406 | 10/1968 | Lutz | 2/24 |
| 3,528,106 | 9/1970 | Austin | 2/2 |
| 4,067,063 | 1/1978 | Ettinger | 2/2 |
| 4,120,052 | 10/1978 | Butler | 2/16 |
| 4,295,227 | 10/1981 | Mitchell | 2/2 |

*Primary Examiner*—Werner H. Schroeder
*Assistant Examiner*—J. L. Olds
*Attorney, Agent, or Firm*—Janine J. Weins; Michael J. Weins

[57] ABSTRACT

The present invention relates to apparel which can be worn during breakdancing as an aid to the dancer in performing the breakdance movements and for distributing impact and torsional loads encountered by the dancer during the breakdance. The breakdance apparel of the present invention in its simplest form is apparel in which those portions of the apparel which contact the support structure have a relatively low coefficient of friction. In a preferred embodiment of the present invention the apparel is provided with resilient regions having an external surface with a relatively low coefficient of friction. In one embodiment the breakdance apparel of the present invention may be in the form of a jacket, jump suit or vest which has been provided with elements having a relatively low coefficient of friction. In another embodiment of the present invention the breakdance apparel is in the form of an accessory designed for placement over those portions of the skeletal frame which may be subject to impact and torsional loads.

11 Claims, 4 Drawing Figures

BREAKDANCE APPAREL

DESCRIPTION

1. Field of Invention

This invention relates to apparel which can be worn during breakdancing as an aid to the dancer in performing the breakdance movements and for distributing impact and torsional loads encountered by the dancer during the breakdance routine.

2. Background

Breakdancing is a form of dance in which the performer frequently contacts the support structure with various parts of the anatomy. After contacting the support structure the breakdancer may spin or flip with respect to the structure.

Breakdancing is preformed on a surface that offers resiliency and has a relatively low coefficient of friction. The breakdancers may use a special surface, may treat the dance surface, or may place a material such as corrugated cardboard over the breakdance surface to impart to the surface resiliency and/or a reduced coefficient of friction.

There is a need for breakdance apparel which can increase the type of surfaces on which breakdancers can preform and which can benefit the breakdancer by distributing impact and torsional loads transmitted to the breakdancer's frame during execution of various of the breakdance maneuvers.

SUMMARY OF INVENTION

The present invention is apparel to be worn by breakdancers. The breakdance apparel of the present invention enhances certain of the breakdance maneuvers such as spinning, and in addition protects the skeletal frame of the breakdancer by distributing torsional and shock loads to which the breakdancer is subjected during certain of the breakdance maneuvers.

The breakdance apparel of the present invention in its simplest form is apparel in which those portions of the apparel which contact the support structure have a relatively low coefficient of friction. In a preferred embodiment of the present invention the apparel is provided with resilient regions having an external surface with a relatively low coefficient of friction. Preferably the breakdance apparel of the present invention distributes impact and torsional loads.

In one embodiment, the breakdance apparel of the present invention may take any of a variety of forms such as a jacket, jump suit or vest. The apparel is provided with elements having a relatively low coefficient of friction. The apparel may also be provided with elements having resiliency. Preferably the apparel has shock absorbing and load distributing padding.

In another embodiment of the present invention the breakdance apparel is in the form of an accessory designed for placement over those portions of the skeletal frame which may be subject to impact and torsional loads. A belt or harness is provided for attaching the apparel accessory to the breakdancer. A boss with a relatively low coefficient of friction to facilitate spinning is provided to the accessory. Preferably a disc is used in combination with the boss.

BEST MODE FOR CARRYING THE INVENTION INTO PRACTICE

Figure 1:
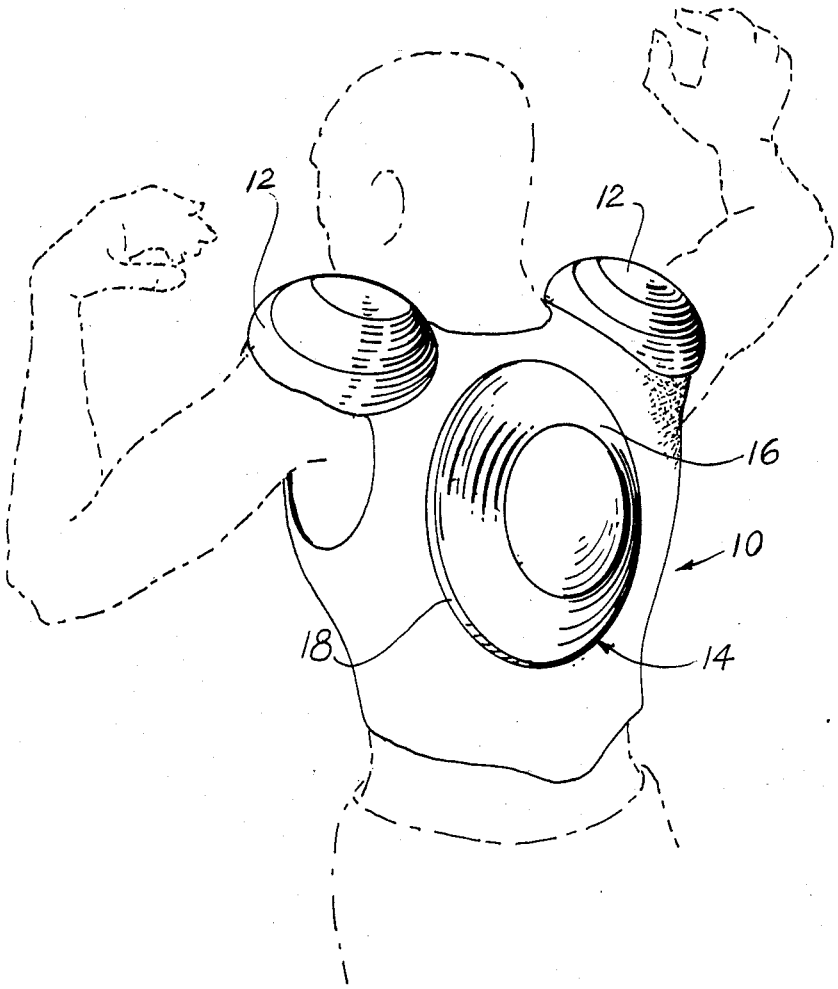
FIG. 1 is a schematic representation of one form of apparel in accordance with the present invention.

FIG. 1 is a schematic representation of one embodiment of the apparel of the present invention. A vest 10 is provided with shoulder elements 12 and a back element 14. The shoulder elements 12 aid the breakdancer during maneuvers which require the breakdancer to flip from one shoulder to another by providing the breakdancer with a resilient shoulder contact. Resiliency can be imparted to the shoulder element 12 by providing an under surface of a material such as rubber. The shoulder element 12 is provided with an outer surface which is abrasion resistant and has a relatively low coefficient of friction such as a polymeric sheet. The shoulder elements 12 preferably protect the breakdancer's shoulders from impact and torsional loading encountered during such flips.

The back element 14 is incorporated into the vest to aid the breakdancer in spinning maneuvers and has an outer surface 16 having a relatively low coefficient of friction. Preferably the back element 14 has a padded region 18 for distributing impact and torsional loads.

Figure 2:
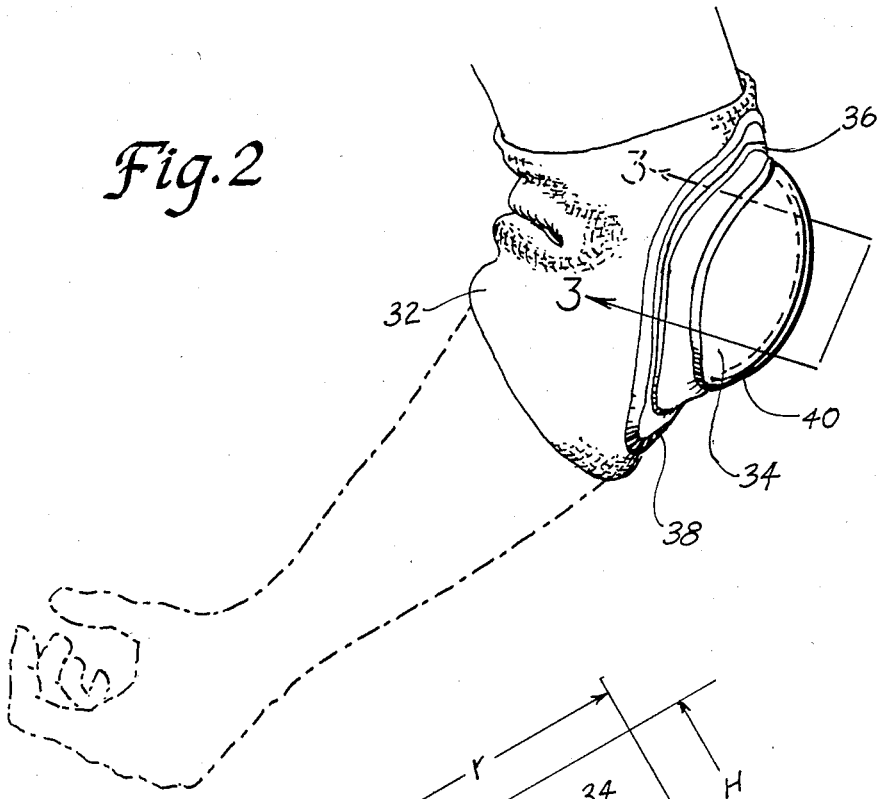
FIG. 2 is a schematic representation of one preferred apparel accessory in accordance with the present invention for the protection of elbow and knee during breakdancing.

FIG. 2 is a schematic representation of one embodiment of the present invention which is designed to distribute impact to elbows and knees while promoting spinning thereon. A pad 30 is placed over the elbow or knee and is held in position with a harness 32 like a belt. The pad had a boss 34 thereon.

Figure 3:
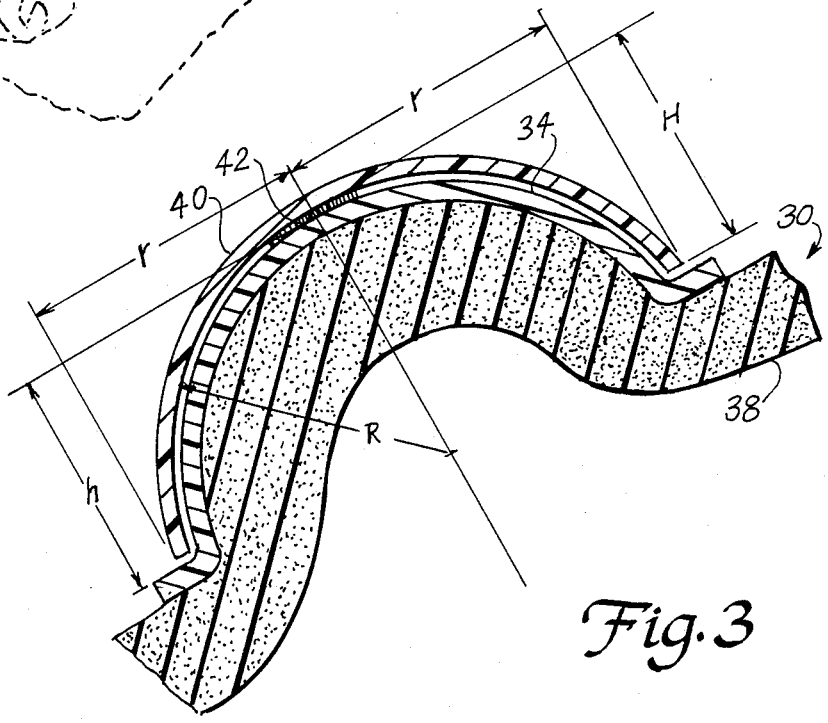
FIG. 3 is a cross section along line 3—3 of the preferred apparel accessory of the present invention shown in FIG. 2.

The pad 30 is preferably constructed of two layers, an outer layer 36 and an inner layer 38. The outer layer 36 is made of an abrasion resistance material such as a polymeric sheet. The inner layer 38 is made of a soft resilient material such as foam. Additional abrasion resistance is furnished when a disc 40 covers the boss 34. The contour of the disk is preferably a spherical cap having a cord radius r between about 5 inches and 12 inches. The radius of curvature, R, of the disk, is between about 10 inches and 40 inches. If the radius falls within the preferred limits the contact area remains sufficiently limited as to reduce the frictional resistance to spinning while providing sufficient contact region to promote rotating stability. The disc 40 is held in position with respect to the boss 34 by fastening means such as "a hook and pile type fastener" such as VELCRO, a trademark of Velcro U.S.A. of Manchester, N.H. closures 42. Further support to the disc 40 is supplied by the boss 34. The boss 34 has a curvature such that it will fit within the curved disk 40. The curvature of the boss 34 should be adjusted such that the height H of the disc 40 matches the height h of the boss 34 as is illustrated in FIG. 3.

Figure 4:
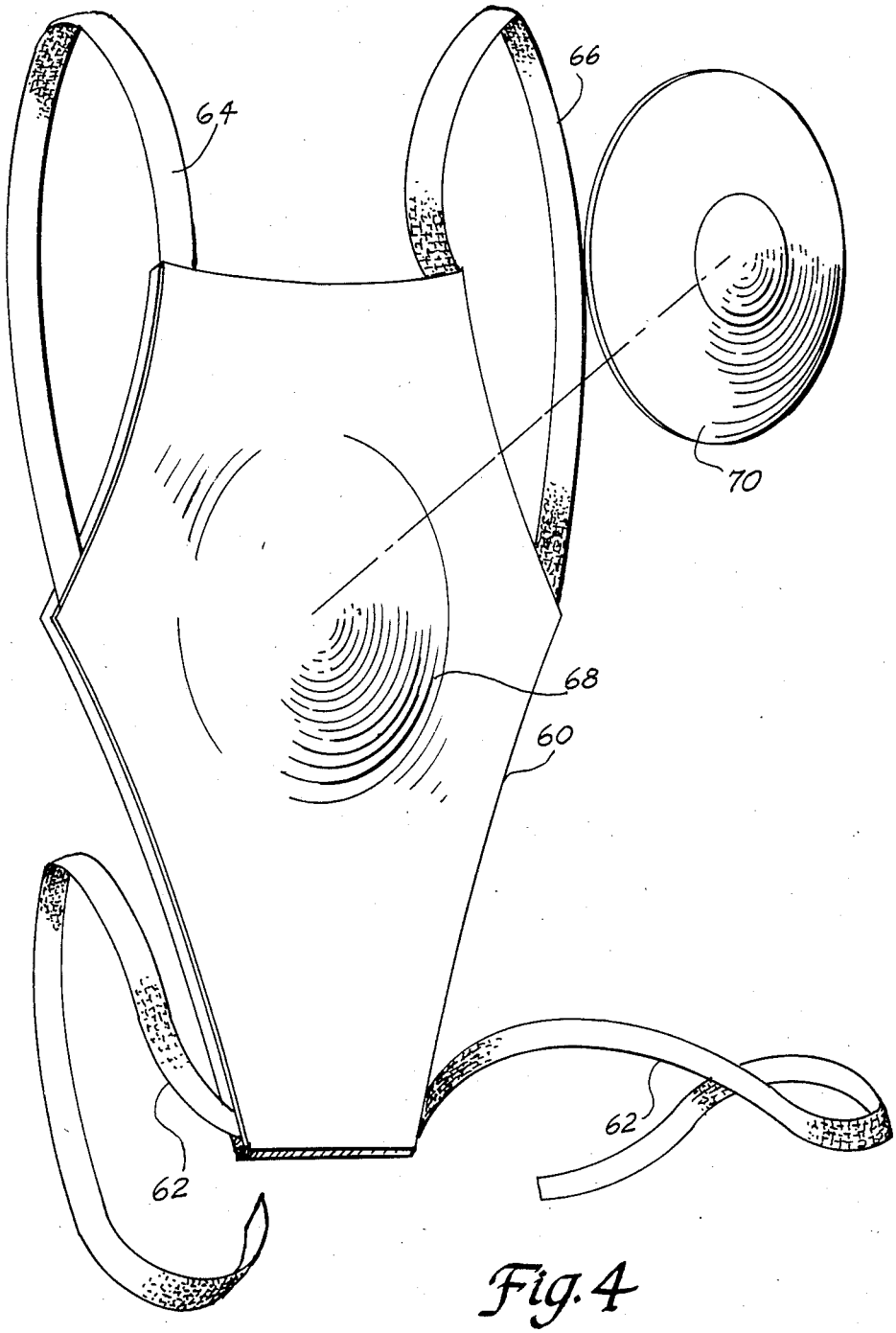
FIG. 4 is a schematic representation of a second preferred apparel accessory of the present invention for promoting back spinning during breakdancing.

FIG. 4 illustrates another embodiment of the present invention designed to protect the breakdancer during back spins. The pad 60 is preferably elongated as illustrated in FIG. 4. The pad 60 is held in position by a harness having a belt 62, a first strap 64 and a second strap 66. The belt 62 wraps around the waist of the breakdancer while the first strap 64 and the second strap 66 provide loops through which the breakdancer places his arms. The belt 62 and the straps 64 and 66 provide three restraints for holding the pad 60 in position. The pad 60 has a boss 68.

A disk 70 is attached to the boss 68. The preferred geometry for the disk and the preferred means for attaching the disk to the boss are as described above.

While the novel features of this invention have been described in terms of preferred embodiments and particular applications, it will be appreciated that various omissions and substitutions in form and in detail of the apparel of the present invention may be made by those skilled in the art without departing from the spirit of the invention.

What I claim is:

1. Improved apparel to be worn during breakdancing for the purpose of facilitating body spinning and protecting the skeletal frame by distributing torsional and impact loads, when the skeletal frame spins or impacts the support structure, the improvement comprising:

elements attached to the apparel which intercede between the skeletal frame and the support structure during breakdancing said elements having an external surface with a coefficient of friction low relative to the coefficient of friction of usual apparel and the naked body.

2. The apparel of claim 1 wherein said elements are further comprised of an outer layer of an abrasion resistant material and an inner layer of a resilient material.

3. An apparel which facilitates body spinning and distributes the torsional and shock loading encountered by the body's skeletal frame, comprising:

a pad for placement over that portion of the skeletal frame which is to be subject to the shock and torsional loading;

a harness which attaches to the body said harness being attached to said pad; and a boss on said pad.

4. The apparel of claim 3 further comprising:

a disc adjacent to said pad however separate from said pad by said boss; and means for attaching said disc to said boss.

5. The apparel of claim 4 wherein said pad is further comprised of an outer layer of an abrasion resistant material and an inner layer of a resilient material.

6. The apparel of claim 4 wherein said disk is contoured so as to form a spherical cap having a cord radius between about 5 inches and 12 inches, and said disk has a radius of curvature between about 10 inches and 40 inches.

7. The apparel of claim 6 wherein said spherical cap has a height which matches said height of said boss.

8. The apparel of claim 7 wherein said means for attaching said disc to said pad is comprised of a hook type surface attached to said pad and a pile type fastener strip attached to said disc.

9. The apparel of claim 4 wherein said harness is comprised of an elastic belt strap.

10. The apparel of claim 9 wherein said elastic belt strap has a hook and pile type fastener.

11. The apparel of claim 10 wherein said harness is further comprised of a first arm strap and a second arm strap.

* * * * *